US006379129B1

(12) United States Patent
Obara

(10) Patent No.: US 6,379,129 B1
(45) Date of Patent: Apr. 30, 2002

(54) BLOWER

(75) Inventor: Rikuro Obara, Miyota-machi (JP)

(73) Assignee: Minebea Kabushiki-Kaisha, Nagano-ken (JP)

( * ) Notice: Subject to any disclaimer, the term of this patent is extended or adjusted under 35 U.S.C. 154(b) by 0 days.

(21) Appl. No.: 09/668,304

(22) Filed: Sep. 25, 2000

(30) Foreign Application Priority Data

Mar. 14, 2000 (JP) ..... 12-070058

(51) Int. Cl.[7] ..... F04B 17/00; F04B 35/04
(52) U.S. Cl. ..... 417/423.12; 384/512
(58) Field of Search ..... 417/231, 423.12, 417/366; 29/898.09; 310/90, 254; 384/450, 512, 535

(56) References Cited

U.S. PATENT DOCUMENTS

| | | | | | |
|---|---|---|---|---|---|
| 5,509,198 | A | * | 4/1996 | Takamizawa et al. | 29/898.09 |
| 5,841,210 | A | * | 11/1998 | Obara | 310/90 |
| 6,007,252 | A | * | 12/1999 | Thelen et al. | 384/535 |
| 6,018,208 | A | * | 1/2000 | Maher et al. | 310/254 |
| 6,050,786 | A | * | 4/2000 | Lin | 417/366 |
| 6,227,714 | B1 | * | 5/2001 | Obura | 384/512 |
| 6,231,242 | B1 | * | 5/2001 | Yano et al. | 384/450 |
| 6,270,325 | B1 | * | 8/2001 | Hsieh | 417/423.12 |
| 6,287,074 | B1 | * | 9/2001 | Chancellor | 415/231 |

* cited by examiner

*Primary Examiner*—Teresa Walberg
*Assistant Examiner*—Leonid M Fastovsky
(74) *Attorney, Agent, or Firm*—Israel Gopstein

(57) ABSTRACT

A blower includes a durable and quiet bearing structure which eliminates or reduces rotational run out, and a bearing wherein the number of essential components and cost for manufacturing is reduced, and the diameter of the shaft can be increased. The blower has an impeller adapted to be rotated upon energizing the blower. The blower has a bearing apparatus which supports the rotational center portion of the impeller, in which the bearing apparatus has a sleeve, and a stepped shaft including a larger diameter portion and a reduced diameter portion provided at one end thereof. A first rolling contact groove is formed at an appropriate position on the outer peripheral surface of the larger diameter portion. A second rolling contact groove is formed on an inner peripheral surface of the sleeve so as to correspond with the first rolling contact groove. Balls of a first row are interposed between the first and second grooves, and an inner race fits over the reduced diameter portion and is secured thereto with an appropriate preloading force. A third rolling contact groove is formed around an outer peripheral surface of the inner race. A fourth rolling contact groove is formed on the inner peripheral surface of the sleeve so as to correspond with the third rolling contact groove. Balls of a second row are interposed between the third and forth grooves.

15 Claims, 8 Drawing Sheets

BLOWER

BACKGROUND OF THE INVENTION

1. Technical Field

The present invention relates especially to a blower suitable in the application for cooling the so-called office automation equipments.

2. Description of the Prior Art

In the case of the prior art, the double row bearing apparatus employed in the blower for cooling the office automation equipments includes a pair of ball bearings 102 and 103 fit on the shaft 101 of the motor as shown in FIG. 8.

The inner races of the ball bearings 102, 103 are loose fit onto the shaft 101, and outer races 102*b*, 103*b* are also loose fit within the sleeve or bearing housing 104, since it is necessary to pre-load each ball bearing through an suitable means such as pre-loading spring.

It is necessary to pre-load both ball bearings 102, 103. The requirement of pre-loading the left ball bearing 102 disposed on the one side of the yoke 105 can be satisfied by applying the pre-loading force thereto through interposing a compression coil spring between the outer end face 102*a* of the left ball bearing 102 and the front face plate 105*a* of the yoke integrally connected with the front face plate 108*a* of the impeller 108. As for the stop ring 107 secured to left end portion of the shaft 101 is required to hold the ball bearing 103.

In the case of the pre-loading means as shown in FIG. 9, it is difficult to apply an appropriate pre-loading force to the bearing. This is because the space defined between the yoke 105 and the ball bearing 102 is too small to accommodate the compression coil spring 106 of the sufficient size to pre-load the bearing properly.

Further, the clearances present between the bearing and the sleeve and/or the shaft will cause upon rotation of the impeller a rotational run out in both radial and thrust directions. This rotational run out will cause noises, affect the blowing characteristics, and reduce the lifetime of the bearing.

The assembling operation of the compression coil spring 106 can not be effected easily since the compression coil spring should be inserted into a limited space against the repulsion of the spring.

The sleeve has at both ends thereof larger inner diameter portions 104*a*, 104*b* for accommodating the outer races of the ball bearings. Each of the larger inner diameter portions includes a shoulder respectively to which the outer race of the ball bearing will be abutted. When the larger inner diameter portions 104*a*, 104*b* are more or less eccentrically formed with respect to the sleeve, the rotational movement of the shaft is also effected eccentrically, and generate vibrations or noises. In this connection, a precise machining on the larger inner diameter portions is required strictly.

As can be seen from the above, the blower employing the double row bearing apparatus of the prior art requires a pair of ball bearings including an inner and outer races, a stop ring, and a pre-loading spring. Of course, the assembling operations for these components are also necessary. This involves a high cost for manufacturing the bearing apparatus.

The more the diameter of the shaft of the motor, the more the rigidity of the shaft, and thus the rotational run out is reduced, and the motor of quiet and high durability can be obtained. However, the diameter of the shaft of the bearing apparatus of the prior art is smaller than that of the sleeve by twice the sum of the thicknesses of inner and outer races of the ball bearings fit around the shaft. In this connection, it is difficult to provide the shaft of good durability, reduced in rotational run out, and reduced in the generation of the vibration or noises.

Accordingly the object of the present invention is to provide a blower comprising a bearing structure wherein the number of components are reduced, the cost for manufacturing can be reduced, and the diameter of the shaft can be increased. The bearing structure in the present invention is good at its durability, eliminate or reduce the rotational run out, and provides outstanding quietness.

SUMMARY OF THE INVENTION

These and other objects are achieved by a blower in accordance with claim 1 having an impeller adapted to be rotated upon energizing the blower comprising;

a bearing apparatus for supporting a rotational center portion of the impeller, the bearing apparatus including;
- a sleeve,
- a stepped shaft including a larger diameter portion and a reduced diameter portion provided at one end thereof,
- the first rolling contact groove formed at an appropriate position around the outer peripheral surface of the larger diameter portion,
- the second rolling contact groove formed on an inner peripheral surface of the sleeve so as to correspond with the first rolling contact groove,
- balls of the first row interposed between the first and second grooves,
- an inner race fit over the reduced diameter portion and secured thereto with an appropriate pre-loading force,
- the third rolling contact groove formed around an outer peripheral surface of the inner race,
- the fourth rolling contact groove formed on the inner peripheral surface of the sleeve so as to correspond with the third rolling contact groove, and
- balls of the second row interposed between the third and fourth grooves.

The blower in accordance with claim 2 comprising;

a frame including a base connected through stays to the frame so as to be positioned at the central portion of the frame, a cylindrical bearing member formed integrally with the base to extend therefrom fowardly, a stator including an iron core and a coil and mounted on the exterior of the cylindrical bearing member, an impeller including a front face plate, a flange formed over the outer periphery of the front face plate, and suitable numbers of blades provided on the outer periphery of the flange, a yoke including a front face plate to which the front face plate of the impeller is secured, a flange formed over the outer periphery of the front face plate, magnet or magnets mounted on the flange, and a bearing apparatus for supporting the central portion of the yoke through a shaft of the bearing apparatus to which the central portion of the yoke is fit and secured thereto, the bearing apparatus including;
- a sleeve,
- a stepped shaft including a larger diameter portion and a reduced diameter portion provided at one end thereof, the first rolling contact groove formed at an appropriate position around the outer peripheral surface of the larger diameter portion, the second rolling contact groove formed on an inner peripheral surface of the sleeve so -as to correspond with the first rolling contact groove, balls of the first row interposed between the first and second grooves, an inner race fit over the reduced diameter portion and secured thereto with an appropriate pre-loading force, the third rolling contact groove formed around an outer peripheral surface of the inner race, the fourth rolling contact groove formed on the inner peripheral surface of the sleeve so as to correspond with the third rolling contact groove, and balls of the second row interposed between the third and fourth grooves.

The blower in accordance with claim 3 comprising;

a frame including a base connected through stays to the frame so as to be positioned at the central portion of the frame, a cylindrical bearing member formed integrally with the base to extend therefrom fowardly, a stator including an iron core and a coil and mounted on the exterior of the cylindrical bearing member, an impeller including a front face plate, a flange formed over the outer periphery of the front face plate, and suitable numbers of blades provided on the outer periphery of the flange, a yoke including a front face plate to which the front face plate of the impeller is secured, a flange formed over the outer periphery of the front face plate, magnet or magnets mounted on the flange, and a bearing apparatus for supporting the central portion of the yoke through a sleeve of the bearing apparatus to which the central portion of the yoke is fit and secured thereto, the bearing apparatus including;

a sleeve, a stepped shaft including a larger diameter portion and a reduced diameter portion provided at one end thereof, the first rolling contact groove formed at an appropriate position around the outer peripheral surface of the larger diameter portion, the second rolling contact groove formed on an inner peripheral surface of the sleeve so as to correspond with the first rolling contact groove, balls of the first row interposed between the first and second grooves, an inner race fit over the reduced diameter portion and secured thereto with an appropriate pre-loading force, the third rolling contact groove formed around an outer peripheral surface of the inner race, the fourth rolling contact groove formed on the inner peripheral surface of the sleeve so as to correspond with the third rolling contact groove, and balls of the second row interposed between the third and fourth grooves.

The blower in accordance with claim 4 comprising;

a frame including a base connected through stays to the frame so as to be positioned at the central portion of the frame, a cylindrical bearing member formed integrally with the base to extend therefrom fowardly, a stator including an iron core and a coil and mounted on the exterior of the cylindrical bearing member, an impeller including a front face plate, a flange formed over the outer periphery of the front face plate, and suitable numbers of blades provided on the outer periphery of the flange, a yoke including a front face plate to which the front face plate of the impeller is secured, a flange formed over the outer periphery of the front face plate, magnet or magnets mounted on the flange, and a bearing apparatus for supporting the central portion of the yoke through a sleeve thereof to which the central portion of the yoke is fit and secured thereto, the bearing apparatus including;

a sleeve, a stepped shaft including a larger diameter portion and a reduced diameter portion provided at one end thereof, the first rolling contact groove formed at an appropriate position around the outer peripheral surface of the larger diameter portion, the second rolling contact groove formed on an inner peripheral surface of the sleeve so as to correspond with the first rolling contact groove, balls of the first row interposed between the first and second grooves, an inner race fit over the reduced diameter portion and secured thereto with an appropriate pre-loading force, the third rolling contact groove formed around an outer peripheral surface of the inner race, the fourth rolling contact groove formed on the inner peripheral surface of the sleeve so as to correspond with the third rolling contact groove, and balls of the second row interposed between the third and fourth grooves, wherein the bearing apparatus is provided within the cylindrical bearing member so that the sleeve can be rotated around the axis of the bearing apparatus, and the end of the shaft is secured to the base.

The blower in accordance with claim 5 comprising;

a frame including a base connected through stays to the frame so as to be positioned at the central portion of the frame, a stator including an iron core and a coil and mounted on the inner peripheral surface of a flange extending fowardly from an outer periphery of the base, an impeller including a front face plate, a flange formed over the outer periphery of the front face plate, and suitable numbers of blades provided on the outer periphery of the flange, a bearing apparatus for supporting the central portion of a supporting plate mounted on the rear surface of the front face plate, the bearing apparatus including;

a sleeve to which the central portion of the supporting plate is fit and secured, a stepped shaft including a larger diameter portion and a reduced diameter portion provided at one end thereof, the first rolling contact groove formed at an appropriate position around the outer peripheral surface of the larger diameter portion, the second rolling contact groove formed on an inner peripheral surface of the sleeve so as to correspond with the first rolling contact groove, balls of the first row interposed between the first and second grooves, an inner race fit over the reduced diameter portion and secured thereto with an appropriate pre-loading force, the third rolling contact groove formed around an outer peripheral surface of the inner race, the fourth rolling contact groove formed on the inner peripheral surface of the sleeve so as to correspond with the third rolling contact groove, and balls of the second row interposed between the third and fourth grooves, wherein the exterior of the sleeve of the bearing apparatus is provided with a cylindrical yoke on which a magnet or magnets corresponding to the coil of the stator is provided, and the end of the shaft is secured to the base.

In the blower in accordance with claim 6, the balls for the first and second rows of any of claims 1 to 5, are made of ceramic material.

In the blower in accordance with claim 7, the outer diameter of the inner race of any of claims 1 to 5 are the same as that of the larger diameter portion of the shaft, and the diameter of the balls for the first row is the same as that of the balls for the second row.

BRIEF DESCRIPTION OF THE DRAWINGS

Further feature of the present invention will become apparent to those skilled in the art to which the present invention relates from reading the following specification with reference to the accompanying drawings, in which.

DETAILED DESCRIPTION OF THE PRESENT INVENTION

Preferred embodiments in accordance with the present invention will now be described with reference to the attached drawings.

The First Embodiment

Figure 1:
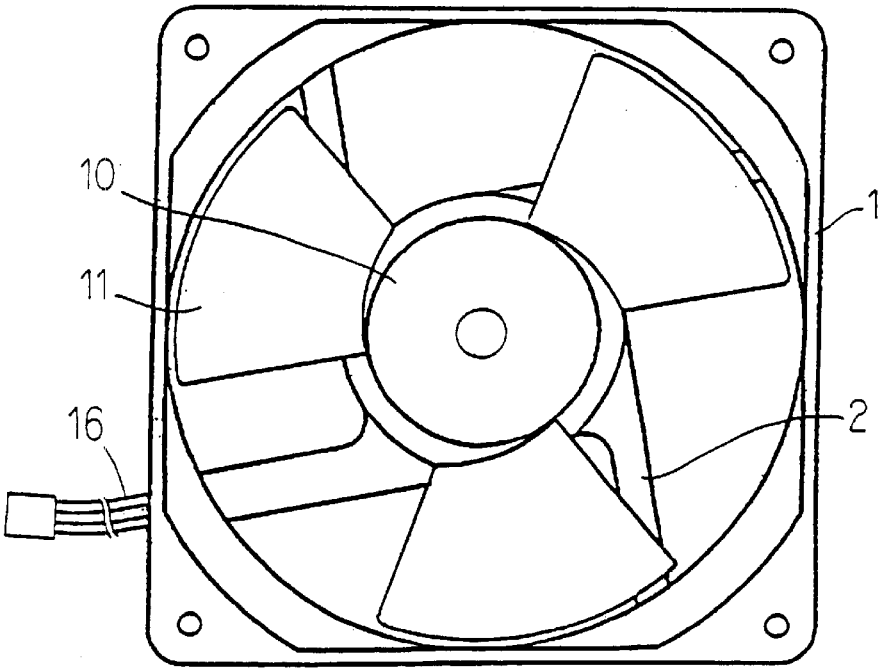
FIG. 1 is a front view showing the first embodiment of the blower in accordance with the present invention.
Figure 2:
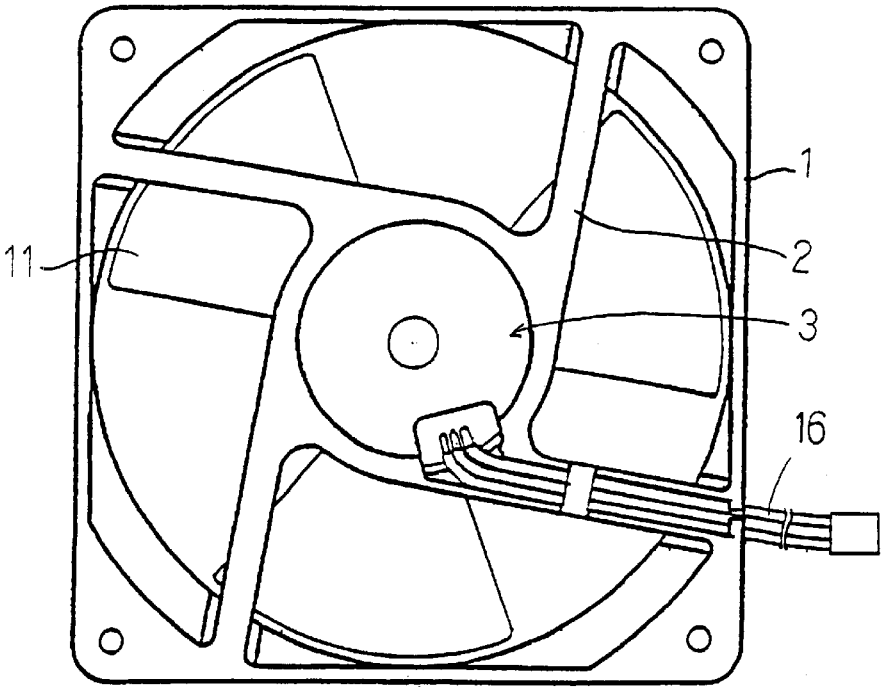
FIG. 2 is a back view showing the first embodiment of the blower in accordance with the present invention.
Figure 3:
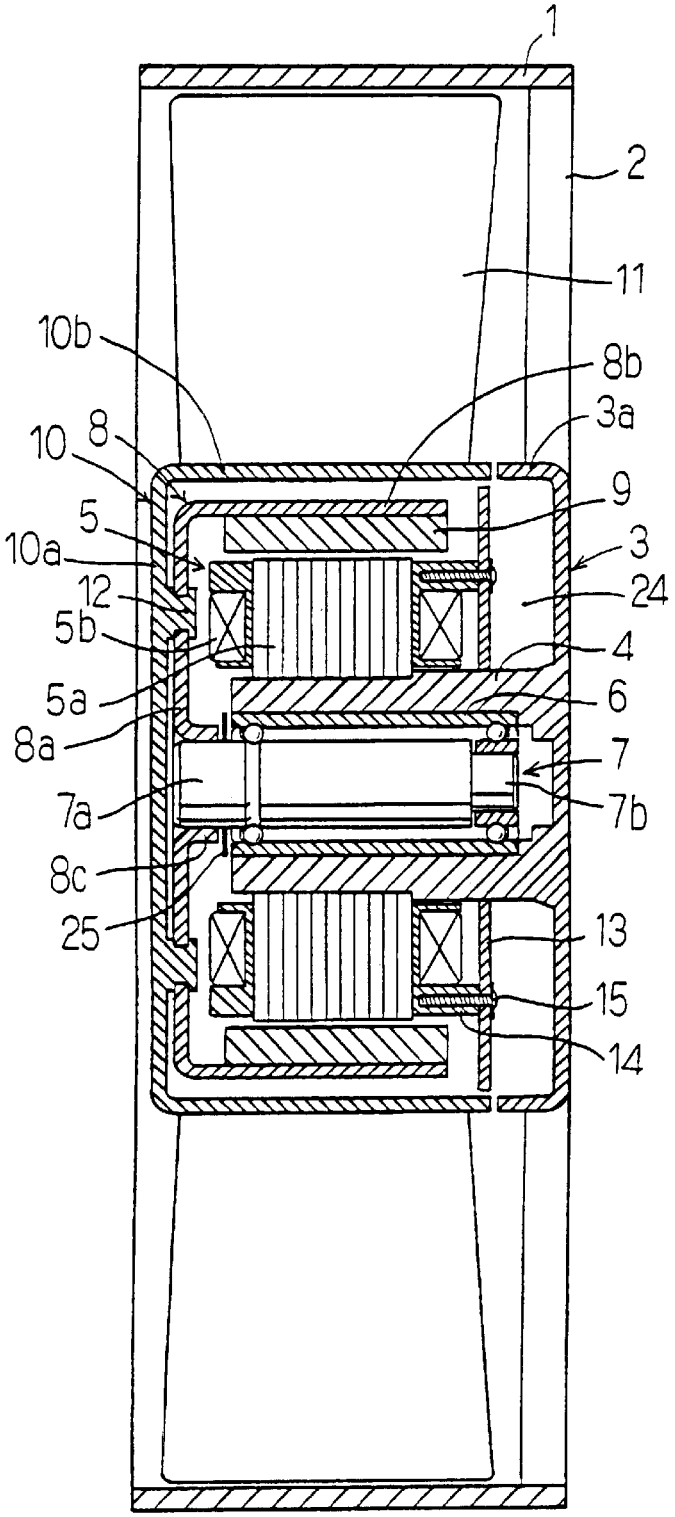
FIG. 3 is a longitudinal view showing the first embodiment of the blower in accordance with the present invention.

The blower in accordance with this embodiment is of the shaft rotating type. The frame of the body of the blower is designated by the reference numeral 1 in FIGS. 1–3. The frame is preferably made of synthetic resin.

A base 3 is supported through a few stays 2 by means of the frame formed integrally therewith. The outer periphery of the base 3 is formed with a frontwardly protruding flange 3*a* forming a rotatably flat cylindrical configuration.

The base also has a frontwardly protruding cylindrical bearing member 4 formed integrally therewith. A stator 5 including an iron core 5*a* and a coil 5*b* is provided around the exterior surface of the bearing member 4. A sleeve 6 served as an outer race of the bearing is secured by adhesive within the interior of the bearing member 4.

A shaft 7 to be journalled through bearing means described hereinbelow is disposed within the sleeve 6. At the distal end of the shaft protruding through the sleeve 6, a hub 8*c* for a central aperture provided through a front face plate 8*a* of a rotor or yoke 8 is fit and secured thereto.

The yoke 8 has at its outer periphery a rearwardly extending flange 8*b*, on the inner surface of which is provided with a magnet or magnets 9 corresponding to the stator 5.

The front face plate 8*a* of the yoke 8 is secured by any known means such as rivets 12 to a front face plate 10*a* of an impeller 10 having at its periphery a rearwardly extending flange 10*b*. The impeller 10 includes suitable numbers of blades 11 attached to the outer periphery of the flange.

The reference numeral 13 is added to a printed circuit board connected at its terminals to the coil of the stator. The printed circuit board is secured to an iron core holder 14 of the stator by means of machine screws 15. The reference numeral 24 is added to leads to the printed circuit board, and the reference numeral 16 is added to the space in which electrical components are to be accommodated.

The reference numeral 25 is added to a dust proof washer of resinous material fit around the outer periphery of the shaft 7. The washer serves to prevent the dusts from immigrating through the clearance defined between the sleeve 6 and the shaft 7 into the bearing apparatus.

In the blower of above mentioned arrangement, energizing the coil of the stator will rotates the yoke 8, and thus the impeller 10 connected to the yoke to provide a blow of wind by the blades.

However, the present invention relates especially to the structure of the bearing apparatus for journaling the shaft. In this connection, we will now describe the structure of the bearing apparatus in detail with reference to FIG. 4.

The shaft 7 is a stepped shaft including a larger diameter portion 7*a* and a reduced diameter portion 7*b* provided at one end of the shaft. A first rolling contact groove 17*a* is formed around the outer periphery of the larger diameter portion at a suitable position. A second rolling contact groove 17*b* is formed on the inner peripheral surface of said sleeve 6 so as to be positioned opposite to the first rolling contact groove 17*a*. A plurality of balls 18*a* of metallic or ceramic material for the first row are interposed between both grooves 17*a*, 17*b*.

An inner race 19 is fit and secured over the reduced diameter portion of the shaft. A third rolling contact groove 20*a* is formed around the outer peripheral surface of the inner race. A fourth rolling contact groove 20*b* is formed on the inner peripheral surface of said sleeve so as to be positioned opposite to the third rolling contact groove 20*a*. A plurality of balls 18*b* of steel or ceramic material for the second row are interposed between both grooves 20*a*, 20*b*.

The balls 18*a*, 18*b* are equal in their diameter. The balls of ceramic material are higher in their hardness, and good at their abrasive resistance and durability.

The length of the reduced diameter portion 7*b* of the shaft is substantially the same as the width of the inner race 19, so that the substantial part of the shaft is provided by larger diameter portion.

The assembling operation of the bearing apparatus will be effected through the following steps; a plurality of balls 18*a* are disposed between the first rolling contact groove 17*a* formed around the shaft and the second rolling contact groove 17*b* formed within the sleeve, a plurality of balls 18*b* are disposed between the third rolling contact groove 20*a* formed around the inner race and the fourth rolling contact groove 20*b* formed within the sleeve, the pre-loading force is applied onto the outer end face of the inner race 19 in parallel to the axis of the shaft (the pre-loading operation can be effected by upstanding the bearing apparatus and then placing the weight on the inner face), and then the inner race is bonded with an appropriate adhesive onto the reduced diameter portion 7*b*.

The securing operation of the inner race onto the shaft may also be made by interference fit or transition fit.

The blower in accordance with the first embodiment can be assembled easily in the following steps; attaching the stator 5 to the cylindrical bearing member 4 of the base 3, fitting or securing the central hub 8*c* of the yoke 8 around which the impeller 10 is connected integrally therewith to the shaft 7 of the bearing apparatus assembled as described above, and then fitting the sleeve 6 of the bearing apparatus into the cylindrical bearing member 4 and bonded thereto.

As can be seen from the above, thus assembled blower does not require a generic ball bearing including both inner and outer races, so that the diameter of the larger diameter portion 7*a* of the shaft can be enlarged by the sum of the thicknesses of the inner and outer races of the ball bearing, and the diameter of the reduced diameter portion 7*b* of the shaft can also be enlarged by the thickness of the outer race of the ball bearing, i.e. generally thick shaft can be obtained.

Accordingly, the shaft of higher rigidity, good at durability, inhibited in its rotational run out, and good at quietness can be provided.

Although the bearing apparatus of the present invention is a double row bearing apparatus, it is unnecessary to employ a pair of ball bearings. This is because the single sleeve having the second and fourth rolling contact grooves formed on the inner peripheral surface thereof will serve as outer races of the ball bearings.

In other words, it is unnecessary to use two outer races of the bearings other than the sleeve, and only one inner race is required on the reduced diameter portion of the shaft.

Further, a stop ring for holding the inner race as well as a pre-loading spring are also unnecessary so that the number of components of the bearing apparatus can be reduced.

The delicate and cumbersome operation required to insert the pre-loading spring into the small space can be precluded, since no pre-loading spring is required.

The Second Embodiment

The blower in accordance with this embodiment is also of the shaft rotating type having a substantially the same structure as that of the first embodiment. The differences between the first and second embodiments are that the cylindrical bearing member 4 is reduced in its length, and the iron core 5a of the stator 5 is provided directly around the sleeve 6.

The Third Embodiment

The blower in accordance with this embodiment is of the sleeve rotating type in which the shaft is stational. The blower of this embodiment will now be described in detail with reference to FIG. 6.

The frame 1 is substantially of the same structure as that of the first embodiment and includes the base 3 positioned at the central portion of the frame. The base 3 has the cylindrical bearing member 4 formed integrally therewith and extending frontwardly (i.e. leftwardly in FIG. 6) therefrom. The stator including the iron core 5*a* and the coil 5*b* is attached to the outer surface of the cylindrical bearing member 4.

Figure 6:
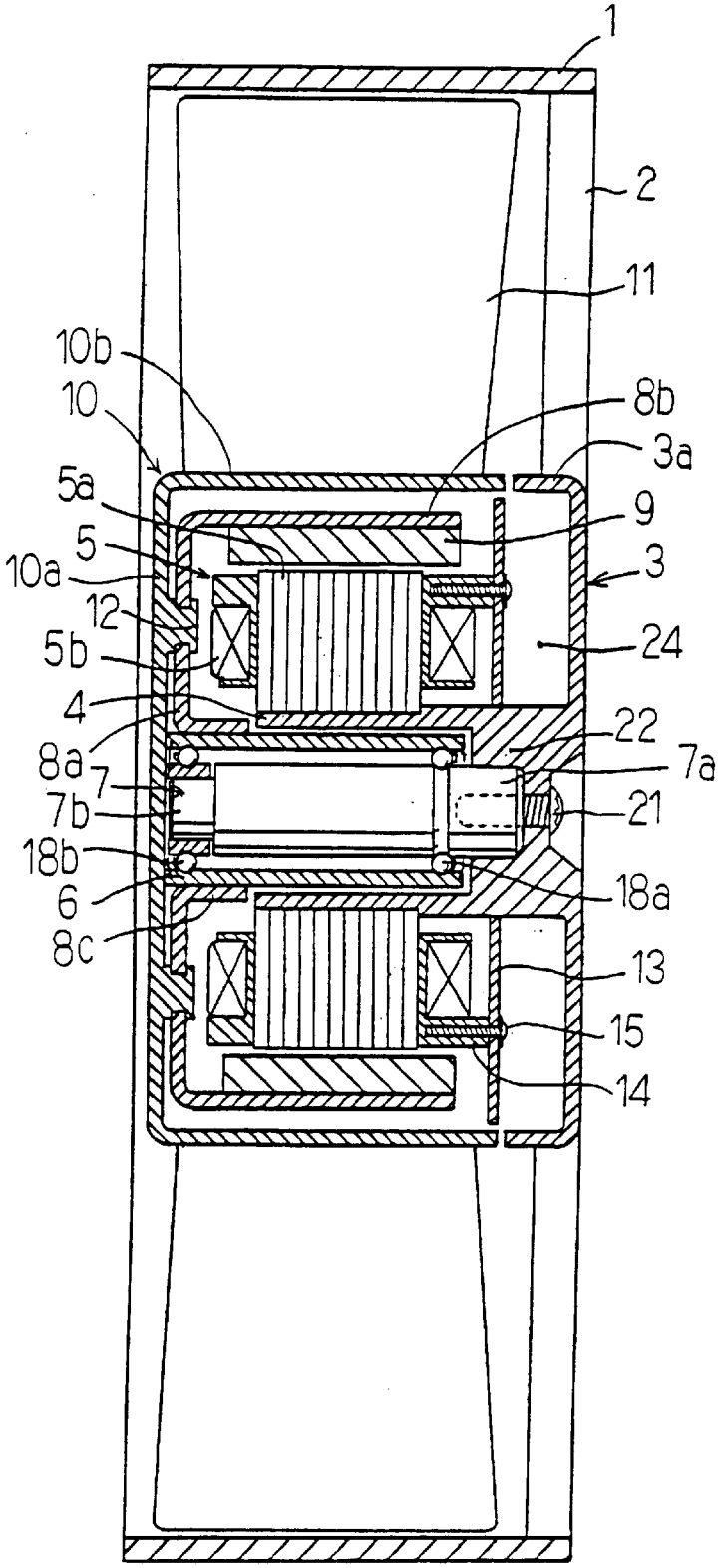
FIG. 6 is a longitudinal view showing the third embodiment of the blower in accordance with the present invention.

The bearing apparatus including the sleeve 6, the shaft 7, the inner race 19, and balls 18*a*, 18*b* interposed therebetween is adapted to be inserted into the cylindrical bearing member 4 as shown in FIG. 6. In this arrangement, the larger diameter portion 7*a* is inserted into a boss 22 of the base 3, and secured thereto by means of a machine screw 21. The outer diameter of the sleeve 6 is smaller than the inner diameter of the member 4 so as to rotate within the member 4.

The front end portion of the sleeve 6 is adapted to be inserted into the hub 8*c* for a central aperture provided through the front face plate 8*a* of the yoke 8, and secured thereto. The yoke 8 has at its periphery the rearwardly (i.e. rightwardly in FIG. 6) extending flange 8*b*, on the inner surface of which is provided with the magnet or magnets 9 corresponding to the stator 5.

The front face plate 8*a* of the yoke 8 is secured by any known means such as rivets 12 to the front face plate 10*a* of the impeller 10 having at its periphery the rearwardly extending flange 10*b*. The impeller 10 includes suitable numbers of blades 11 attached to the outer periphery of the flange.

In the blower of above mentioned arrangement, energizing the coil of the stator will rotates the yoke 8 together with the sleeve, and thus the impeller 10 connected to the yoke to provide a blow of wind by the blades 11.

The blower of this embodiment can be assembled easily in the following steps; attaching the stator 5 to the cylindrical bearing member 4 of the base 3, fitting the sleeve 6 of the bearing apparatus into the hub 8*c* of the yoke and secured thereto to connect the impeller to the bearing, inserting the sleeve 6 of the bearing apparatus into the cylindrical bearing member 4 of the base 3, and securing the rear end of the shaft to the boss 22 of the base by means of the machine screw 21.

The Fourth Embodiment

Figure 7:
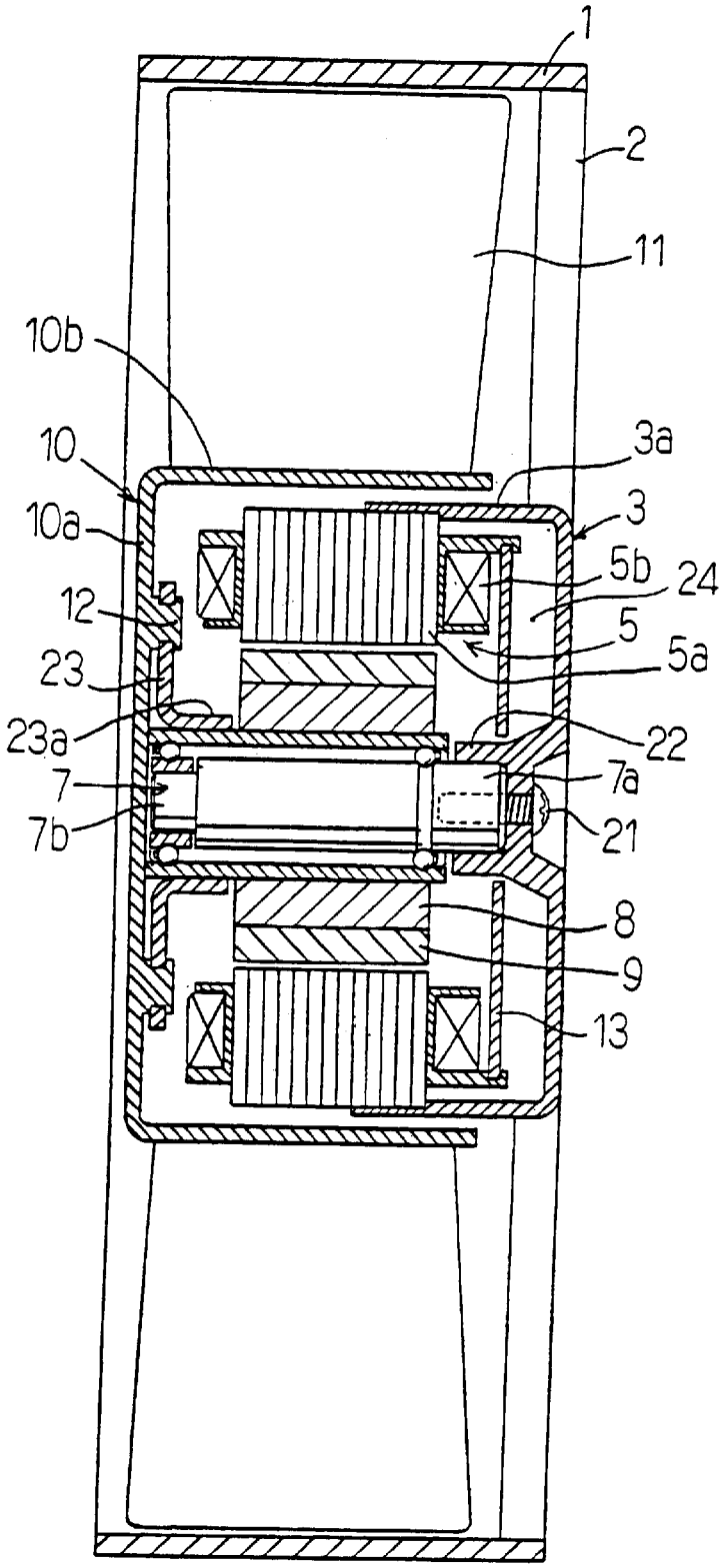
FIG. 7 is a longitudinal view showing the third embodiment of the blower in accordance with the present invention.
Figure 8:
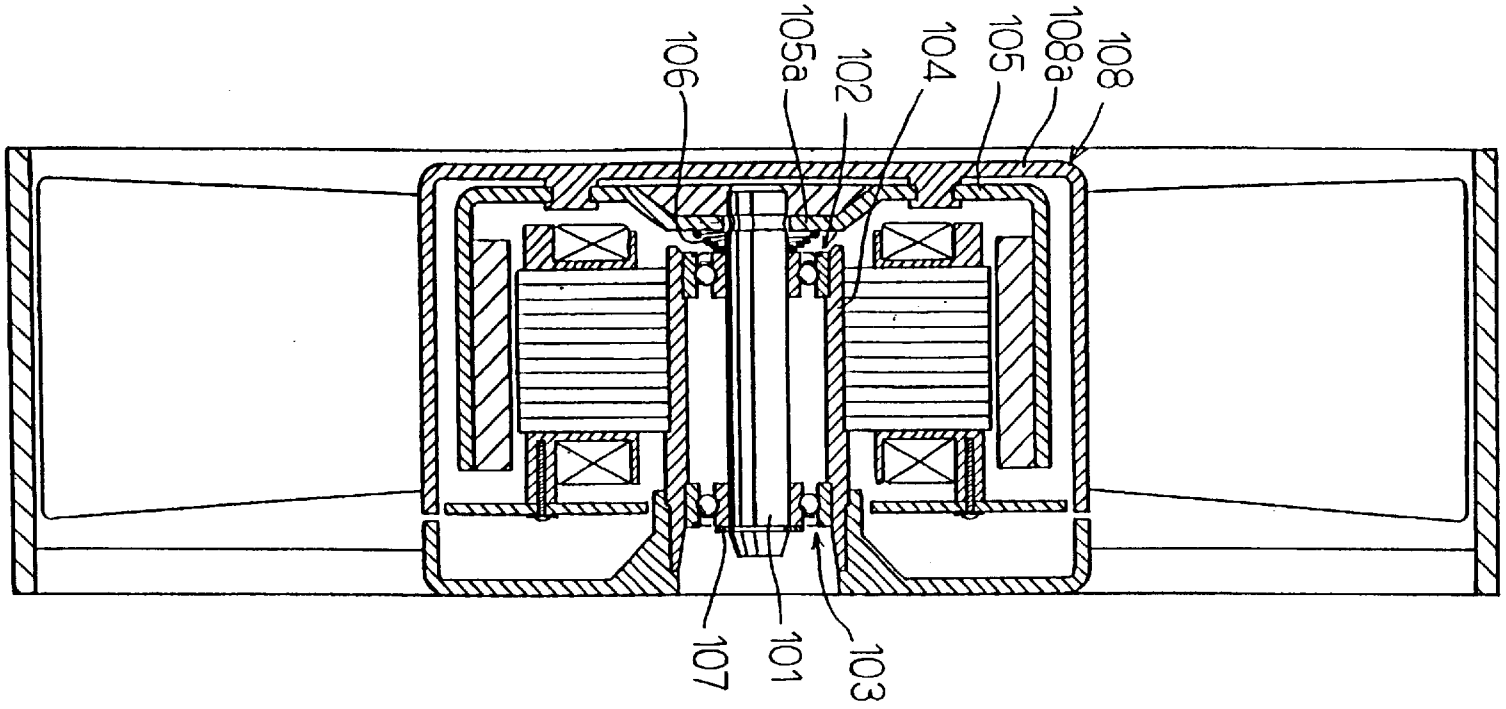
FIG. 8 Prior Art
FIG. 8 is a longitudinal view showing an example of the blower of the prior art.
Figure 9:
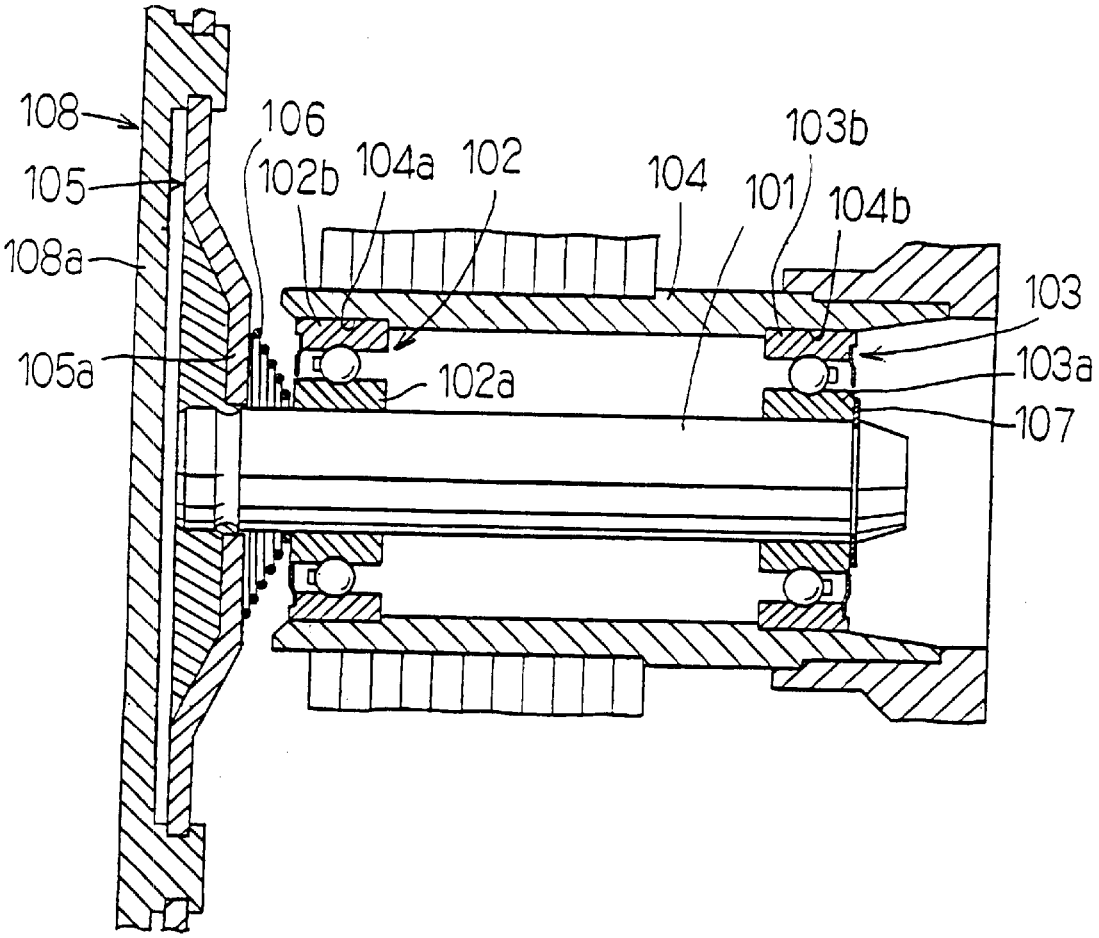
FIG. 9 Prior Art
FIG. 9 is an enlarged cross-sectional view showing the bearing apparatus of the blower of the prior art.

The blower in accordance with this embodiment is of the sleeve rotating type in which the shaft is stational. The blower of this embodiment will now be described in detail with reference to FIG. 7.

The differences between the third and fourth embodiments are that the base 3 does not have the cylindrical bearing member, the yoke is a cylindrical member, and the stator 5 is secured to the base.

Figure 4:
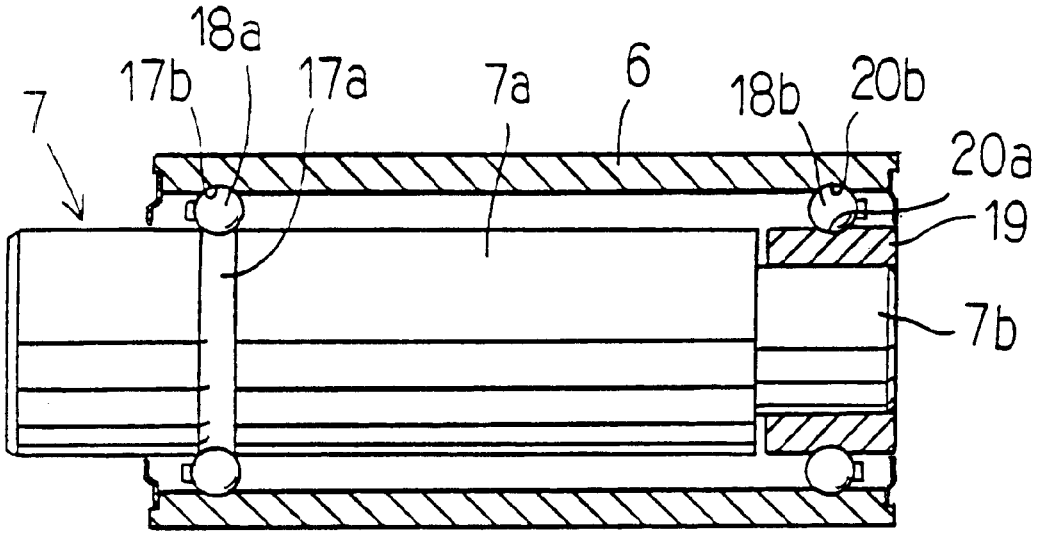
FIG. 4 is an enlarged cross-sectional view showing the bearing apparatus of the blower in accordance with the present invention.
Figure 5:
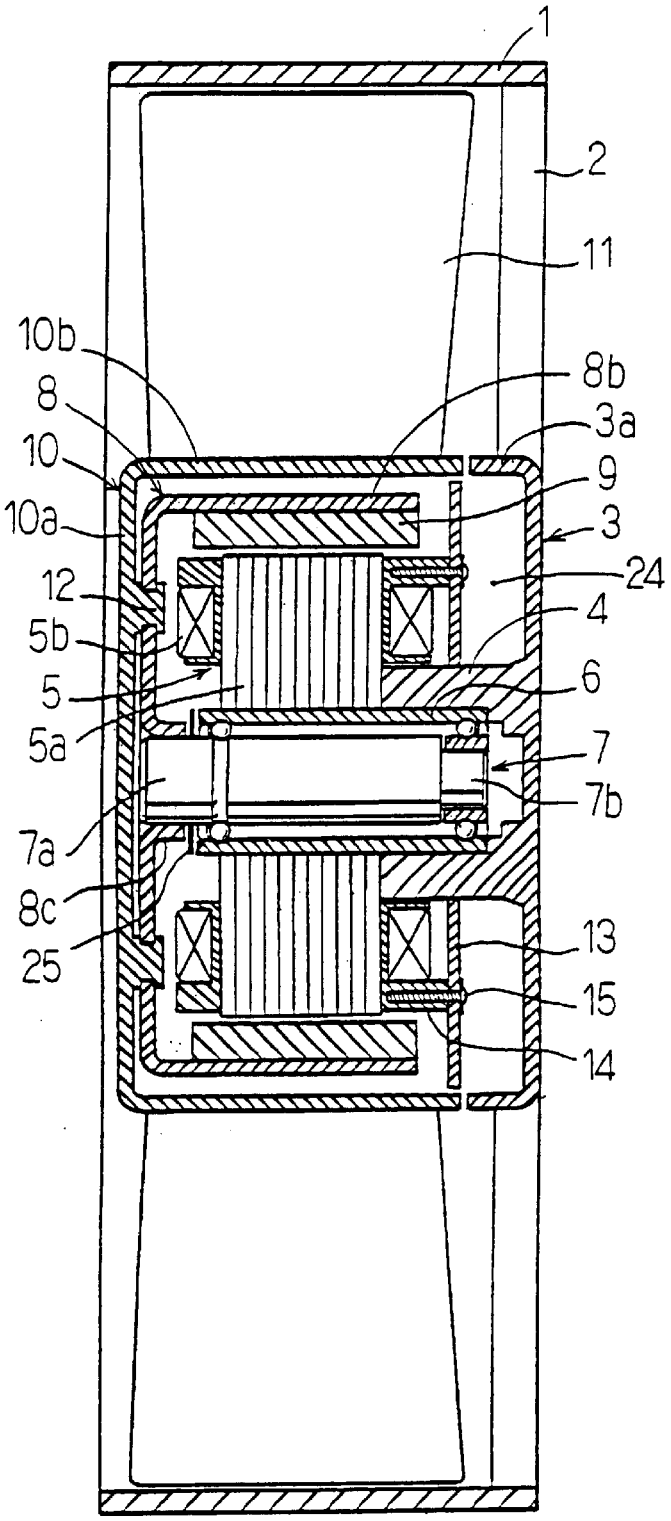
FIG. 5 is a longitudinal view showing the second embodiment of the blower in accordance with the present invention.

The blower includes the stator attached to the inner peripheral surface of the flange 3*a* extending frontwardly from the base 3, and the magnet or magnets 9 connected onto the annular yoke 8 fit around the exterior of the sleeve of the bearing apparatus of FIG. 4 and secured thereto. The magnet or magnets 9 are spaced from the inner peripheral surface of the stator 5.

The front end portion of the sleeve 6 is adapted to be inserted into a hub 23*a* for a central aperture provided through a supporting plate 23 and secured thereto. The supporting plate 23 is secured by any known means such as rivets 12 to the front plate portion 10*a* of the impeller 10.

In the blower of above mentioned arrangement, energizing the coil of the stator will rotates the yoke 8 together with the sleeve 6, and thus the impeller 10 connected to the sleeve through the supporting plate 23 to provide a blow of wind by the blades 11.

The blower of this embodiment can be assembled easily in the following steps; attaching the stator 5 to the flange 3*a* of the base 3, fitting the sleeve 6 into the hub 23*a* of the supporting plate 23 connected integrally to the impeller 10, mounting the yoke 8 and the magnet or magnets 9 on the sleeve 6 to form a bearing apparatus, inserting thus obtained bearing apparatus into the stator 5, and securing the bottom end of the shaft to the boss 22 of the base 3 by means of the machine screw 21.

The Effects or Advantages

As can be seen from the above, the bearing apparatus of the blower in accordance with the present invention does not require a generic ball bearing including both inner and outer races, so that the diameter of the larger diameter portion of the shaft can be enlarged by the sum of the thicknesses of the inner and outer races of the ball bearing, and the diameter of the reduced diameter portion of the shaft can also be enlarged by the thickness of the outer race of the ball bearing, i.e. generally thick shaft can be obtained.

Accordingly, the shaft of higher rigidity, good at durability, inhibited in its rotational run out, and good at quietness can be provided.

Although the bearing apparatus of the present invention is a double row bearing apparatus, it is unnecessary to employ a pair of ball bearings. This is because the single sleeve having the second and fourth rolling contact grooves formed on the inner peripheral surface thereof will serve as outer races of the ball bearings.

In other words, it is unnecessary to use two outer races of the bearings other than the sleeve, and only one inner race is required on the reduced diameter portion of the shaft.

Further, a stop ring for holding the inner race as well as a pre-loading spring are also unnecessary so that the number of components of the bearing apparatus can be reduced.

The delicate and cumbersome operation required to insert the pre-loading spring into the small space can be precluded, since no pre-loading spring is required.

The bearing apparatus is an already completed product upon which a suitable amount of pre-loading force is applied, when the impeller is to be assembled into the frame. In this connection, delicate and cumbersome pre-loading operation is no longer required when the impeller is mounted on the bearing apparatus, so that the assembling operation of the impeller can be effected easily and quickly.

Further, it is unnecessary to form lager inner diameter portions at the interior portions of both ends of the sleeve served also as the outer race, so that the rotational run out caused by the eccentricity between the sleeve and the lager inner diameter portions and the generation of the noise accompanied therewith can be avoided.

The bearing assembly of the prior art in which the sleeve and the shaft are journalled through a pair of ball bearings interposed therebetween with any clearance will generate the rotational run out in both radial and thrust directions and genarate vibrations and/or noise, whereas the bearing apparatus of the present invention in which the inner race is secured on the reduced diameter portion and balls are accommodated within the grooves formed on the outer surface of the shaft and the inner race and the inner surface of the sleeve and contact with these grooves, does not allow the run out in the radial and thrust directions to produce, so that the impeller can rotate quietly.

While particular embodiments of the present invention have been illustrated and described, it should be obvious to those skilled in the art that various changes and modifications can be made without departing from the spirit and scope of the invention.

What is claimed is:

1. A blower having an impeller adapted to be rotated upon energizing the blower comprising;

a bearing apparatus for supporting a rotational center portion of the impeller, the bearing apparatus including;

a sleeve, a stepped shaft including a larger diameter portion and a reduced diameter portion provided at one end thereof, the first rolling contact groove formed at an appropriate position around the outer peripheral surface of the larger diameter portion, the second rolling contact groove formed on an inner peripheral surface of the sleeve so as to correspond with the first rolling contact groove, balls of the first row interposed between the first and second grooves, an inner race fit over the reduced diameter portion and secured thereto with an appropriate pre-loading force, the third rolling contact groove formed around an outer peripheral surface of the inner race, the fourth rolling contact groove formed on the inner peripheral surface of the sleeve so as to correspond with the third rolling contact groove, and balls of the second row interposed between the third and fourth grooves.

2. A blower comprising;

a frame including a base connected through stays to the frame so as to be positioned at the central portion of the frame, a cylindrical bearing member formed integrally with the base to extend therefrom fowardly, a stator including an iron core and a coil and mounted on the exterior of the cylindrical bearing member, an impeller including a front face plate, a flange formed over the outer periphery of the front face plate, and suitable numbers of blades provided on the outer periphery of the flange, a yoke including a front face plate to which the front face plate of the impeller is secured, a flange formed over the outer periphery of the front face plate, magnet or magnets mounted on the flange, and a bearing apparatus for supporting the central portion of the yoke through a shaft of the bearing apparatus to which the central portion of the yoke is fit and secured thereto, the bearing apparatus including;

a sleeve, a stepped shaft including a larger diameter portion and a reduced diameter portion provided at one end thereof, the first rolling contact groove formed at an appropriate position around the outer peripheral surface of the larger diameter portion, the second rolling contact groove formed on an inner peripheral surface of the sleeve so as to correspond with the first rolling contact groove, balls of the first row interposed between the first and second grooves, an inner race fit over the reduced diameter portion and secured thereto with an appropriate pre-loading force, the third rolling contact groove formed around an outer peripheral surface of the inner race, the fourth rolling contact groove formed on the inner peripheral surface of the sleeve so as to correspond with the third rolling contact groove, and balls of the second row interposed between the third and fourth grooves.

3. A blower comprising;

a frame including a base connected through stays to the frame so as to be positioned at the central portion of the frame, a cylindrical bearing member formed integrally with the base to extend therefrom fowardly, a stator including an iron core and a coil and mounted on the exterior of the cylindrical bearing member, an impeller including a front face plate, a flange formed over the outer periphery of the front face plate, and suitable numbers of blades provided on the outer periphery of the flange, a yoke including a front face plate to which the front face plate of the impeller is secured, a flange formed over the outer periphery of the front face plate, magnet or magnets mounted on the flange, and a bearing apparatus for supporting the central portion of the yoke through a sleeve of the bearing apparatus to which the central portion of the yoke is fit and secured thereto, the bearing apparatus including;

a sleeve, a stepped shaft including a larger diameter portion and a reduced diameter portion provided at one end thereof, the first rolling contact groove formed at an appropriate position around the outer peripheral surface of the larger diameter portion, the second rolling contact groove formed on an inner peripheral surface of the sleeve so as to correspond with the first rolling contact groove, balls of the first row interposed between the first and second grooves, an inner race fit over the reduced diameter portion and secured thereto with an appropriate pre-loading force, the third rolling contact groove formed around an outer peripheral surface of the inner race, the fourth rolling contact groove formed on the inner peripheral surface of the sleeve so as to correspond with the third rolling contact groove, and balls of the second row interposed between the third and fourth grooves.

4. A blower comprising;

a frame including a base connected through stays to the frame so as to be positioned at the central portion of the frame, a cylindrical bearing member formed integrally with the base to extend therefrom fowardly, a stator including an iron core and a coil and mounted on the exterior of the cylindrical bearing member, an impeller including a front face plate, a flange formed over the outer periphery of the front face plate, and suitable numbers of blades provided on the outer periphery of the flange, a yoke including a front face plate to which the front face plate of the impeller is secured, a flange formed over the outer periphery of the front face plate, magnet or magnets mounted on the flange, and a bearing apparatus for supporting the central portion of the yoke through a sleeve thereof to which the central portion of the yoke is fit and secured thereto, the bearing apparatus including;

a sleeve, a stepped shaft including a larger diameter portion and a reduced diameter portion provided at one end thereof, the first rolling contact groove formed at an appropriate position around the outer peripheral surface of the larger diameter portion, the second rolling contact groove formed on an inner peripheral surface of the sleeve so as to correspond with the first rolling contact groove, balls of the first row interposed between the first and second grooves, an inner race fit over the reduced diameter portion and secured thereto with an appropriate pre-loading force, the third rolling contact groove formed around an outer peripheral surface of the inner race, the fourth rolling contact groove formed on the inner peripheral surface of the sleeve so as to correspond with the third rolling contact groove, and balls of the second row interposed between the third and fourth grooves, wherein the bearing apparatus is provided within the cylindrical bearing member so that the sleeve can be rotated around the axis of the bearing apparatus, and the end of the shaft is secured to the base.

5. A blower comprising;

a frame including a base connected through stays to the frame so as to be positioned at the central portion of the frame, a stator including an iron core and a coil and mounted on the inner peripheral surface of a flange extending fowardly from an outer periphery of the base, an impeller including a front face plate, a flange formed over the outer periphery of the front face plate, and suitable numbers of blades provided on the outer periphery of the flange, a bearing apparatus for supporting the central portion of a supporting plate mounted on the rear surface of the front face plate, the bearing apparatus including;

a sleeve to which the central portion of the supporting plate is fit and secured, a stepped shaft including a larger diameter portion and a reduced diameter portion provided at one end thereof, the first rolling contact groove formed at an appropriate position around the outer peripheral surface of the larger diameter portion, the second rolling contact groove formed on an inner peripheral surface of the sleeve so as to correspond with the first rolling contact groove, balls of the first row interposed between the first and second grooves, an inner race fit over the reduced diameter portion and secured thereto with an appropriate pre-loading force, the third rolling contact groove formed around an outer peripheral surface of the inner race, the fourth rolling contact groove formed on the inner peripheral surface of the sleeve so as to correspond with the third rolling contact groove, and balls of the second row interposed between the third and fourth grooves, wherein the exterior of the sleeve of the bearing apparatus is provided with a cylindrical yoke on which a magnet or magnets corresponding to the coil of the stator is provided, and the end of the shaft is secured to the base.

6. The blower of claim 1, wherein the balls are made of ceramic material.

7. The blower of claim 1, wherein the outer diameter of the inner race is same as that of the larger diameter portion of the shaft, and the diameter of the balls for the first row is same as that of the balls for the second row.

8. The blower of claim 2, wherein the balls are made of ceramic material.

9. The blower of claim 2, wherein the outer diameter of the inner race is same as that of the larger diameter portion of the shaft, and the diameter of the balls for the first row is same as that of the balls for the second row.

10. The blower of claim 3, wherein the balls are made of ceramic material.

11. The blower of claim 3, wherein the outer diameter of the inner race is same as that of the larger diameter portion of the shaft, and the diameter of the balls for the first row is same as that of the balls for the second row.

12. The blower of claim 4, wherein the balls are made of ceramic material.

13. The blower of claim 4, wherein the outer diameter of the inner race is same as that of the larger diameter portion of the shaft, and the diameter of the balls for the first row is same as that of the balls for the second row.

14. The blower of claim 5, wherein the balls are made of ceramic material.

15. The blower of claim 5, wherein the outer diameter of the inner race is same as that of the larger diameter portion of the shaft, and the diameter of the balls for the first row is same as that of the balls for the second row.

* * * * *